US006027107A

United States Patent [19]

Natsume et al.

[11] Patent Number: 6,027,107

[45] **Date of Patent: *Feb. 22, 2000**

[54] IMAGE FORMING APPARATUS CAPABLE OF A PLURALITY OF PROCESSES ON SHEET PROVIDED WITH IMAGE

[75] Inventors: Junko Natsume, Aichi-Ken; Hiroshi Yamada, Toyokawa; Kazuo Inui, Toyohashi, all of Japan

[73] Assignee: Minolta Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/947,016

[22] Filed: Oct. 8, 1997

[30] Foreign Application Priority Data

Mar. 6, 1997 [JP] Japan ..... 9-051477

[51] Int. Cl.[7] ..... B41L 43/12

[52] U.S. Cl. ..... 270/37; 270/58.07; 399/410; 493/405

[58] Field of Search ..... 399/410, 401; 270/37, 58.07, 58.08, 58.11; 493/320, 325, 405

[56] References Cited

U.S. PATENT DOCUMENTS

| | | | |
|---|---|---|---|
| 4,592,651 | 6/1986 | Oikawa et al. | 270/37 X |
| 4,763,167 | 8/1988 | Watanabe et al. | 399/410 |
| 4,988,030 | 1/1991 | Muramatu et al. | 270/58.07 |
| 5,037,077 | 8/1991 | Kubota et al. | 270/58.12 |
| 5,129,640 | 7/1992 | Kosaka et al. | 270/37 |
| 5,137,265 | 8/1992 | Sato et al. | 270/58.12 |
| 5,192,942 | 3/1993 | Yamada et al. | 399/130 X |
| 5,478,061 | 12/1995 | Murakami et al. | 270/58.08 |
| 5,709,376 | 1/1998 | Ushirogata | 270/58.11 |
| 5,797,596 | 8/1998 | Morigami et al. | 270/58.11 |

FOREIGN PATENT DOCUMENTS

| | | |
|---|---|---|
| 402008165A | 1/1990 | Japan . |
| 07196232 | 1/1995 | Japan . |
| 408324874A | 12/1996 | Japan . |

*Primary Examiner*—Christopher P. Ellis
*Assistant Examiner*—Patrick Mackey
*Attorney, Agent, or Firm*—McDermott, Will & Emery

[57] ABSTRACT

A user sets a function of corner stapling, two-point stapling or punching on an operation panel of a copying machine, as a process for a paper after copying. Then, the copying machine determines whether or not a function of folding the paper after copying is set, for setting a position for corner stapling, two-point stapling or punching on a portion suitable for each folding method. The user can set the paper folding function and the stapling or punching function in a combined manner, and the facility of the copying machine is improved.

11 Claims, 16 Drawing Sheets

IMAGE FORMING APPARATUS CAPABLE OF A PLURALITY OF PROCESSES ON SHEET PROVIDED WITH IMAGE

BACKGROUND OF THE INVENTION

1. Field of the Invention

The present invention relates to an image forming apparatus, and more particularly, it relates to an image forming apparatus which can execute processes such as paper folding, stapling and the like on a paper provided with an image.

2. Description of the Related Art

An image forming apparatus such as a copying machine, is known to be capable of performing processes such as paper folding, stapling and punching on a paper after forming an image thereon. Also known is a copying machine which can set the position of a binding margin.

Japanese Patent Laying-Open No. 7-196232 (1995) discloses a technique of determining whether or not the relation between a position for forming a binding margin and that for stapling is defective and informing the user of the result of the determination. According to this technique, it is possible not only to inform the user of the result of determination but to inhibit an operation of image formation on the basis of the result for to avoid stapling the paper on the position for forming a binding margin.

In the aforementioned technique disclosed in Japanese Patent Laying-Open No. 7-196232, however, it is hard to determine what setting is to be concretely made for removing the defectiveness, although the user can recognize that the relation between the position for forming a binding margin and that for stapling is defective. Thus, a warning message may be issued to prevent image formation even if the user performs a series of resets.

Further, an image forming apparatus has so many functions nowadays that it is difficult to combine the functions (processes) with each other.

SUMMARY OF THE INVENTION

Accordingly, an object of the present invention is to readily set a plurality of postprocesses in an image forming apparatus having postprocessing functions.

Another object of the present invention is to readily set positions for paper folding, stapling and punching in an image forming apparatus having postprocessing functions.

The aforementioned objects of the present invention are attained by an image forming apparatus including a first set unit for setting a first process which is performed on a sheet provided with an image, and a second set unit for automatically setting a position on the sheet to be subjected to a second process which is different from the first process in response to setting of the first process by the first set unit.

After setting of the first process, the position on the sheet being subject to second process is automatically set in response thereto, whereby a plurality of postprocesses can be reliably set. Consequently, it is possible to provide an image forming apparatus which can readily set a plurality of postprocesses.

According to another aspect of the present invention, an image forming apparatus includes a finisher for selectively or simultaneously executing automatic paper folding for automatically folding a sheet which is provided with an image, automatic stapling for automatically stapling a prescribed position on the sheet, and automatic punching for automatically punching a prescribed position on the sheet, a first set unit for setting the automatic folding, and a second set unit for automatically setting the positions on the sheet to be subjected to the automatic stapling and the automatic punching.

After setting of the automatic paper folding, the positions on the sheet to be subjected to the automatic stapling and the automatic punching are set in response thereto, whereby the positions for the paper folding, the stapling and the punching can be readily set.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

A preferred embodiment of the present invention is now described with reference to the drawings.

<Structure of Copying Machine>

Figure 1:
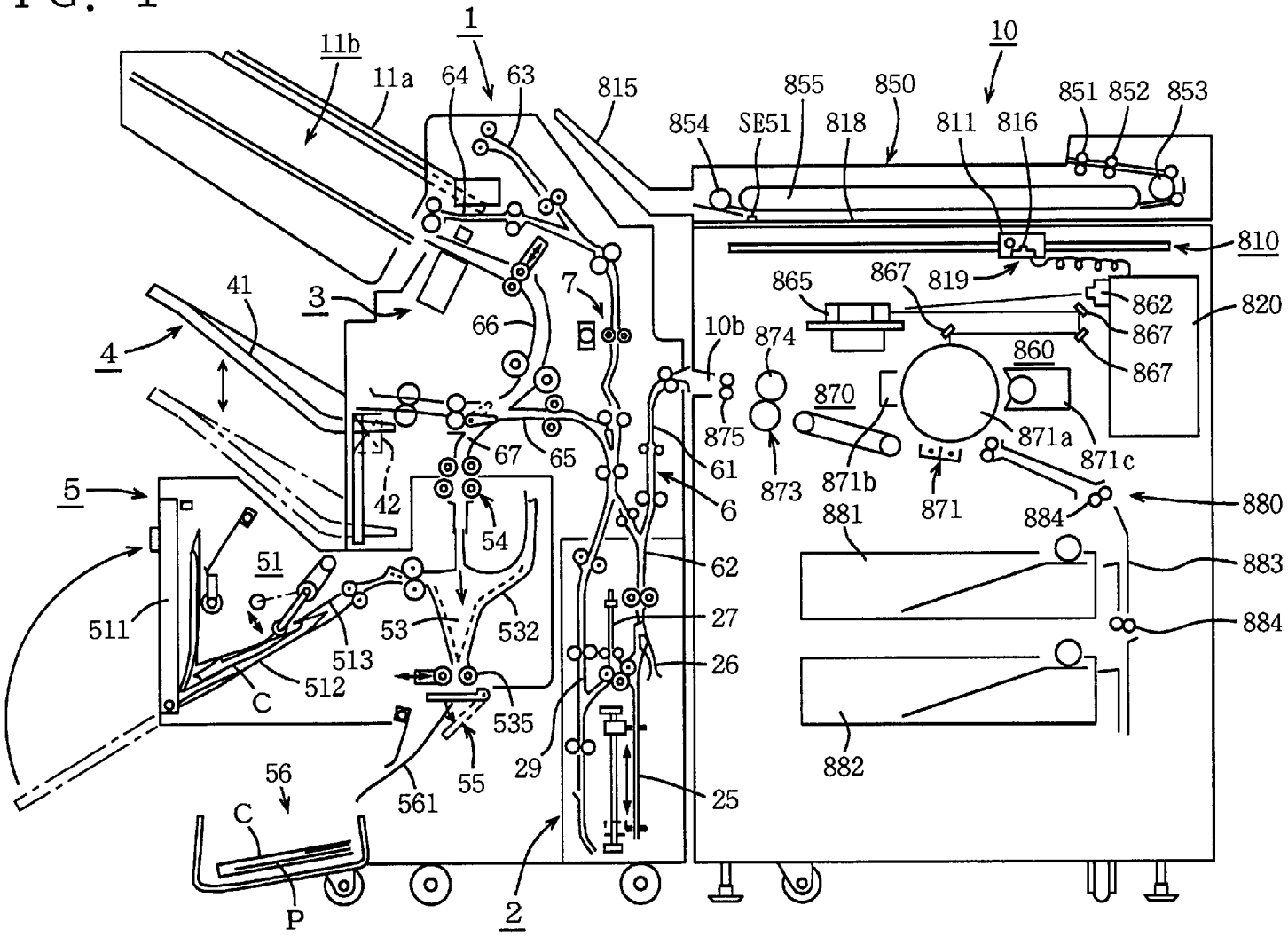
FIG. 1 illustrates the overall structure of a copying machine provided with a finisher according to an embodiment of the present invention.

Referring to FIG. 1, a copying machine 10, called a digital copying machine, is roughly formed by a scan system 810 reading originals to be copied, an image signal processing part 820 processing read image data, a laser optical system 860 for outputting the read image data onto papers, and an image forming system 870. An ADF (automatic document feeder) 850 is provided on an upper portion of the copying machine 10 for feeding the originals to be copied and reversing the same at need. An operation panel OP is provided on an upper surface of the copying machine 10, for setting various operation modes for image edit processing performed in the copying machine 10, the number of copy papers and the like.

A finisher 1 provided a binding part, a paper folding part, a punching part and a stapling part as described later is mounted on this copying machine 10.

Figure 2:
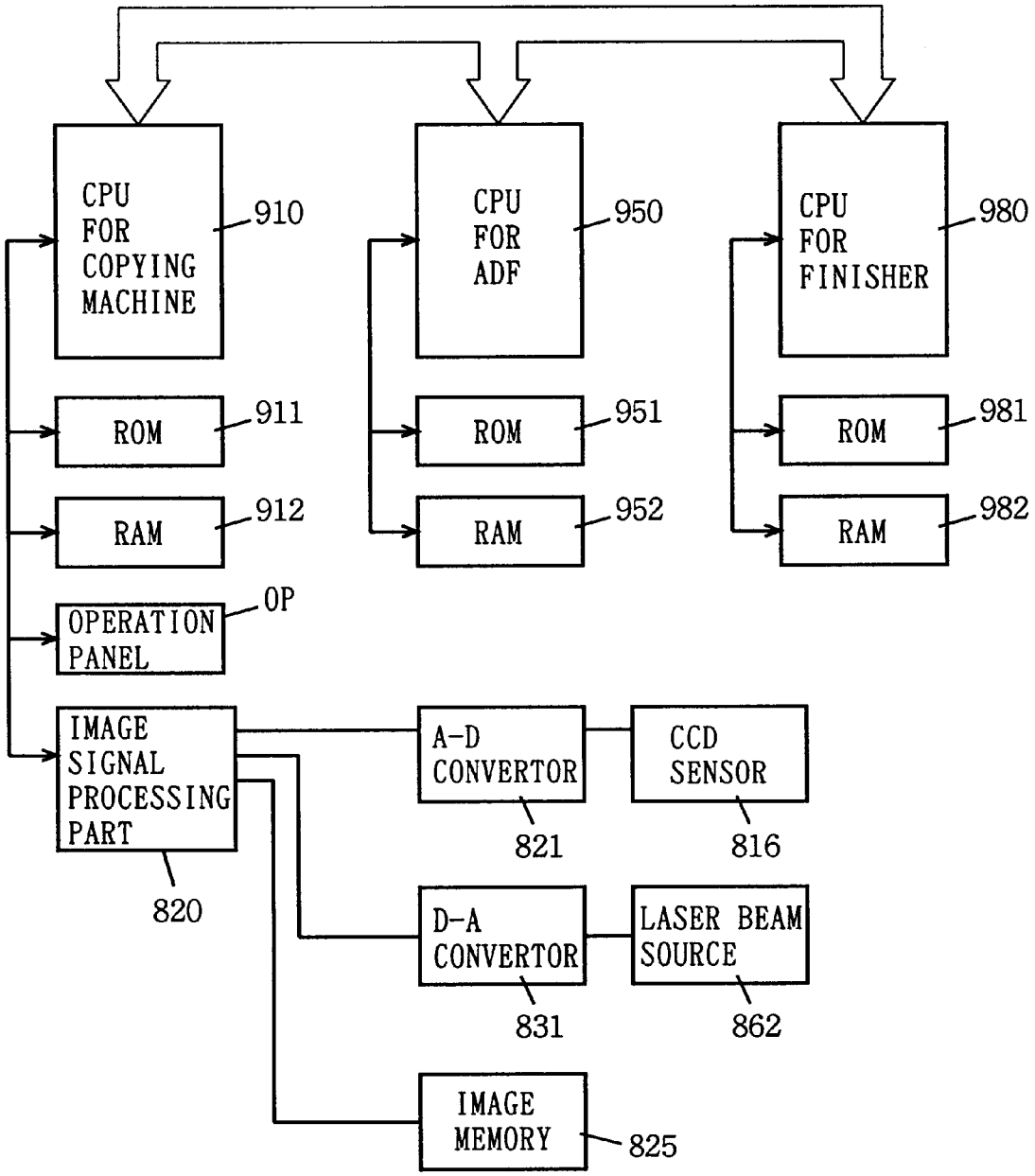
FIG. 2 is a block diagram showing a control system of the copying machine.

As shown in FIG. 2, a control system controlling operations of the overall copying machine 10 including the ADF 850 and the finisher 1 is formed by CPUs 910, 950 and 980 for controlling the copying machine 10, the ADF 850 and the finisher 1 respectively. These CPUs 910, 950 and 980 are provided with ROMs 911, 951 and 981 storing necessary programs and RAMs 912, 952 and 982 employed for various processes respectively.

The operation panel OP and the image signal processing part 820 are connected to the CPU 910 for the copying machine 10. Operations of the respective parts of the copying machine 10 are performed by commands from the CPU 910 for the copying machine 10. A CCD sensor 816 is connected to the image signal processing part 820 through an A-D converter 821. Further, a laser beam source 862 of the laser optical system 860 is also connected to the image signal processing part 820 through a D-A converter 831. In addition, the image signal processing part 820 is provided with an image memory 825 for storing the read image data.

Functions and operations of the respective parts of the copying machine 10 are now described in detail.

First, originals which are set on an original tray 815 of the ADF 850 are fed one by one to a prescribed position on a platen glass member 818 by a command from the CPU 950 for the ADF 850. The originals are read by the scan system 810, and thereafter discharged on a discharge tray provided on the ADF 850. Original feed rollers 851, 852, 853 and 854 and a transport belt 855 of the ADF 850 are driven to feed the originals.

When the originals are fed, the sizes thereof are detected one by one in response to ON/OFF time of a sensor SE51 which is set in the ADF 850. Signals from the sensor SE51 are transmitted to the CPU 910 for the copying machine 10 through the CPU 950 for the ADF 850.

In the scan system 810, a scanner 819 is driven by a scan motor (not shown). The scanner 819 moves under the platen glass member 818. An exposure lamp 811 mounted on the scanner 819 irradiates each original which is placed on the platen glass member 818 with light. The CCD sensor 816 which is a photoelectric conversion element receives reflected light, for scanning/reading original images.

The laser optical system 860 is formed by the laser beam source (semiconductor laser) 862, a polygon mirror 865 deflecting the laser beam, and reflecting mirrors 867. The image forming system 870 is formed by a develop/transfer system 871, a feeding system 880 for feeding the papers, and a fixing system 873 for fixing the images. The develop/transfer system 871 is formed by a photoreceptor drum 871*a*, a corona charger 871*b*, a developing unit 871*c* storing a developer and supplying toner to the photoreceptor drum 871*a*, a transfer charger (not shown) for transferring toner images formed on the photoreceptor drum 871*a* to the papers, a paper separation charger (not shown) for separating the papers from the photoreceptor drum 871*a*, and a cleaning plate (not shown) for removing unnecessary part of the toner from the photoreceptor drum 871*a*.

The feeding system 880 is formed by cassettes 881 and 882 storing papers, a paper guide 883, timing rollers 884 and the like. The sizes of the papers stored in the cassettes 881 and 882 are previously decided so that the paper sizes are determined in response to the cassettes 881 and 882 respectively. While FIG. 1 shows two cassettes 881 and 882, the copying machine 10 may comprise three or more cassettes.

The fixing system 873 is formed by fixing rollers 874 for feeding the papers while thermocompressing the same, discharge rollers 875, and a discharge sensor (not shown) for detecting paper discharge.

Printed papers are transmitted from a paper discharge part 10*b* to the finisher 1 described later.

<Schematic Structure of Finisher 1>

Figure 3:
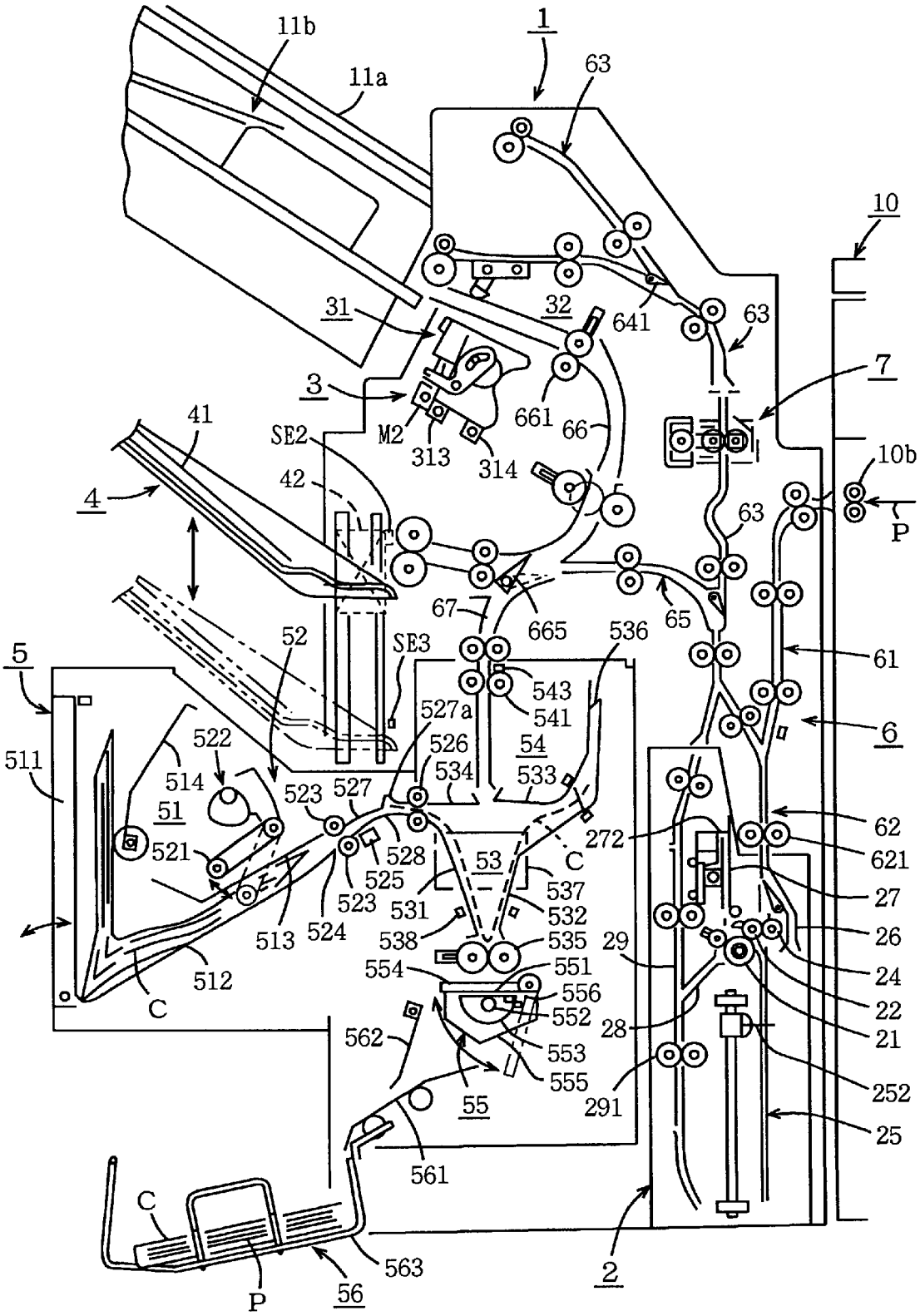
FIG. 3 illustrates the structure of the finisher.

FIG. 3 is an enlarged view of the finisher 1. As shown in FIGS. 1 and 3, the finisher 1 is roughly formed by a non-sort tray 11*a* and a paper integration part 11*b* for integrating and aligning papers P discharged from the paper discharge part 10*b* of the copying machine 10, a paper folding part 2 for folding the papers P discharged from the paper discharge part 10*b* and folded in two or in the form of Z (hereinafter referred to as Z folding) at need, a stapling part 3 which is set downstream the paper integration part 11*b* along the paper feed direction for stapling the integrated and aligned papers P, a sort part 4 for receiving and storing a bunch of the stapled papers P, a binding part 5 for covering the stapled paper bunch or an unstapled paper bunch, and a punching part 7 provided on a paper feeding path for punching the papers P at need. The papers P discharged from the copying machine 10 are fed to the respective parts in the finisher 1 by a paper feeding part 6.

<Sort Part>

As shown in FIGS. 1 and 3, the sort part 4 has a sort tray 41 and a drive 42 for vertically moving the sort tray 41. The papers P are fed to the sort tray 41 one by one through a feeding path 65 in mass copying, or the paper bunch which are fed from the paper integration part 11*b* to the stapling part 3 and stapled is fed to the sort tray 41 through a feeding path 66. The papers P or the paper bunch fed from the feeding path 65 or 66 is guided to the sort tray 41 or the binding part 5 by a switching pawl 665.

Every time a sensor SE2 detects a paper P stored and placed on the sort tray 41, the drive 42 moves the sort tray 41 downward by a constant amount. When a sensor SE3 detects movement of the sort tray 41 to the lower limit, the copying operation is interrupted since the sort tray 41 is full in this state. The structure of the drive 42 for moving the sort tray 41 downward is well known in the art and hence description thereof is omitted.

<Paper Folding Part>

Figure 4:
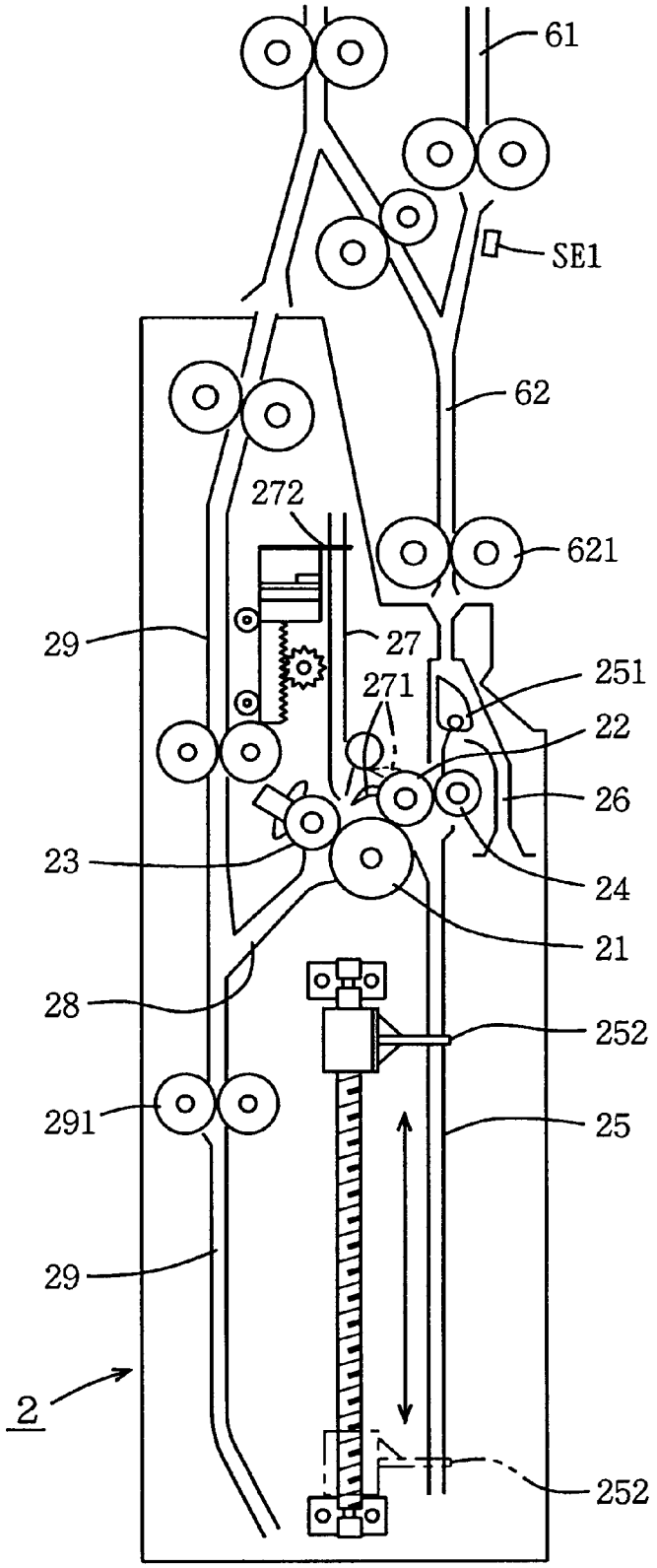
FIG. 4 is an enlarged view showing a paper folding part.

FIG. 4 is an enlarged view of the paper folding part 2. As shown in FIGS. 3 and 4, the paper folding part 2 is provided immediately under the paper feeding part 6. The paper folding part 2 has a function of folding each paper P provided with an image in two at the center of the paper feed direction, and a function of folding each paper P in the form of Z.

Principal parts of the paper folding part 2 are three reversible paper folding rollers 21, 22 and 23 and a backup roller 24. The papers P are transferred through a plurality of paper feeding paths 25 to 29 along the rollers 21 to 24.

The paper folding functions are now described.

The paper folding part 2 has two paper folding modes which can be selected by manipulating the operation panel OP of the copying machine 10.

[Z Folding Mode]

This mode is adapted to fold each paper P in the form of Z. As shown in FIG. 4, the paper P fed from the discharge part 10*b* through feeding paths 61 and 62 is passed through a switching member 251 and fed toward the first feeding path 25 by a pair of switchback rollers 621. The paper P is temporarily stopped by the paper folding roller 22 and the backup roller 24 which are stopped. When the paper folding roller 22 is driven, the paper P is fed to come into contact with a stopper 252 which is set on a prescribed position. When coming into contact with the stopper 252, the paper P defines a loop in the vicinity of the paper folding rollers 21 and 22. This loop is nipped by nippers of the paper folding rollers 21 and 22, to be subjected to first folding.

In response to Z folding order command from the copying machine 10, paper P subjected to the first folding is fed to the second feeding path 27 by a switching operation of a switching member 271, to come into contact with another stopper 272. The paper P stopped by this stopper 272 defines a loop in the vicinity of nippers of the paper folding rollers 21 and 23. This loop is nipped by the nippers of the paper folding rollers 21 and 23, to be subjected to second folding. The paper P subjected to the second folding and folded in the form of Z is fed to the third feeding path 28, and further fed toward the switchback feeding path 29. A pair of switchback rollers 291 are reversed to feed the paper P toward a feeding path 63.

[Two-Folding Mode]

This mode is adapted to fold each paper P in two at its center. In this mode, first folding is performed through a process similar to that in the Z folding mode, except the position of the first stopper 252.

The switching member 271 provided on an inlet of the second feeding path 27 is not rotated to guide the paper P to the second feeding path 27, and hence the paper P subjected to the first folding is directly fed toward the nippers of the paper folding rollers 21 and 23. Namely, the paper P passed through the paper folding rollers 21 and 22 is immediately nipped by the nippers of the paper folding rollers 21 and 23, and directly fed to the third feeding path 28. Thereafter the paper P is fed to the switchback feeding path 29, and then fed toward the feeding path 63 by the pair of switchback rollers 291, similarly to the Z folding mode. Thus, the paper P is fed while directing the folded side downward.

<Stapling Part>

Figure 5:
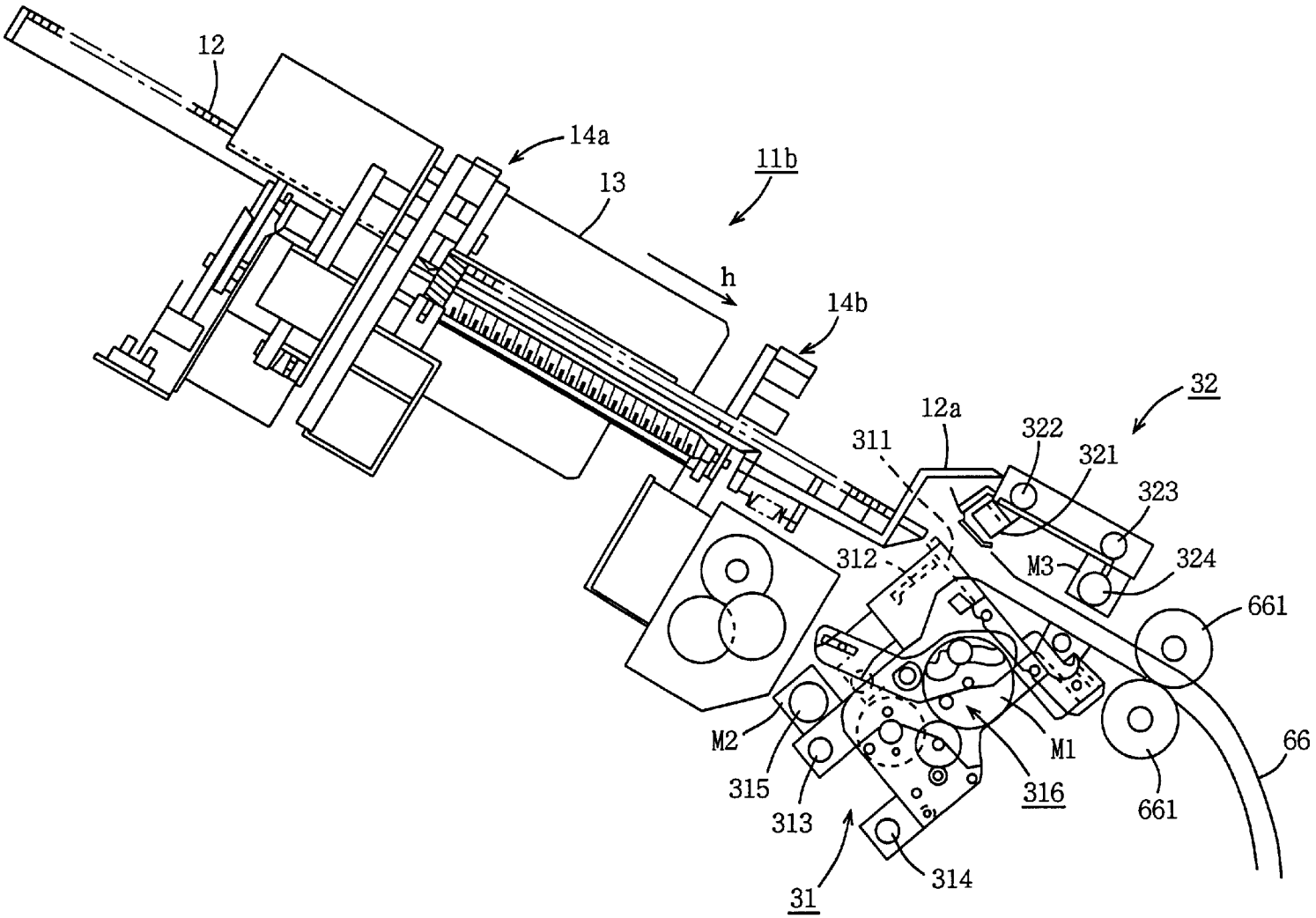
FIG. 5 is an enlarged view showing a stapling part.

FIG. 5 is an enlarged view of the stapling part 3. As shown in FIGS. 2 and 5, the papers P discharged from a feeding path 64 are aligned in the paper integration part 11b, so that prescribed positions of the paper bunch are stapled. The stapling part 3 has a staple delivery part 31 for delivering staples, and a staple receiving part 32 for receiving and bending the delivered staples.

In the paper integration part 11*b*, a forward end stopper 12*a* receives and aligns forward ends (rear ends as viewed from the direction of discharge to the tray 12) of the papers P discharged onto the tray 12, and a side portion aligning plate 13 reciprocates perpendicularly to the paper feed direction for aligning transverse directions of the papers P. In covered binding, therefore, the folded sides of the papers P are directed toward the forward end stopper 12*a*. First and second chucking parts 14*a* and 14*b* alternately grasp side portions of the papers P for preventing the papers P from floating, while the first chucking part 14*a* grasps the paper bunch and feeds the papers P toward the stapling part 3.

The staple delivery part 31 drives a staple cutting member and a staple bending member 312 through a cam link mechanism 316 which is driven by a motor M1, for cutting the staples stored in a staple cartridge 311 one by one, separating the same from each other and discharging the separated staples toward the staple receiving part 32. The staple receiving part 32 has a staple receiving member 321 for bending the staples in a U-shaped manner and binding the paper bunch.

The staples are driven perpendicularly to the paper feed direction h as follows: The staple delivery part 31 is slidably mounted on two guide shafts 313 and 314, and rendered movable following normal/reverse rotation of a spiral shaft 315 which is provided perpendicularly to the paper feed direction h by a stepping motor M2. The staple receiving part 32 is also slidably mounted on two guide shafts 322 and 323, and moved perpendicularly to the paper feed direction h following normal/reverse direction of a spiral shaft 324 which is driven by a stepping motor M3.

Positions for driving the staples in the paper feed direction h are decided in response to the movement of the papers P by the chucking part 14*a*. Thus, the integrated papers P can be stapled in any positions between the forward ends and the rear ends thereof in response to the amount of delivery of the first chucking portion 14*a*. In case of covered binding, end portions (forward ends as viewed from the direction of discharge to the tray 12) of the papers P folded in two are thrusted to reach the position of the staple delivery part 31. After the stapling, the papers P are held by a pair of feed rollers 661 which are rendered separable from each other, and fed through the feeding path 66.

<Binding Part>

The binding part 5 is adapted to bunch the papers P after copying and paste the same with a commercially available cover. As shown in FIG. 3, the binding part 5 is formed by a cover storage part 51 storing a plurality of commercially available binding covers C, a cover feeding part 52 for taking out a cover C from the cover storage part 51 and feeding the same, a paper insertion part 53 for holding the cover C fed by the cover feeding part 52 in a paper receiving state, a paper feeding part 54 for inserting the paper bunch discharged from the paper discharge part 10*b* and fed through a feeding path 67 into the cover C, a heating part 55 for heating the cover C receiving the papers P in the paper insertion part 53, and a discharge part 56 for discharging the bound cover C to the exterior of the binding part 5 and storing the same.

Thus, the paper bunch aligned in the paper integration part 11*b* is fed to the binding part 5 through the feeding paths 66 and 67 as such or after stapling to be bound, or the papers P folded by the paper folding part 2 are fed one by one to the binding part 5 through the feeding path 65 to be bunched and bound.

In a space of the cover storage part 51 for storing the covers C, each cover C is stored in a V-shaped open state (the state shown in FIG. 3) by a open/close door 511, a cover holding member 514 and storage lower guide plates 512 and 513.

The cover feeding part 52 has a pickup roller 521 which comes into contact with front and rear surfaces of each cover C stored in the cover storage part 51 for feeding the forward end thereof, a roller pressing member 522 for pressing the pickup roller 521 against the cover C under pressure, a pair of separation rollers 523 for feeding only a single cover C, a preseparation member 524 arranged upstream the pair of separation rollers 523, a cover detection part 525 arranged downstream the pair of separation rollers 523, a pair of cover feed rollers 526 arranged downstream the pair of separation rollers 523, and cover feeding guides 527 and 528 which are formed to connect the cover storage part 51 with the paper insertion part 53.

The paper insertion part 53 is formed by guide plates 531, 532, 533 and 534 defining an inverted triangular paper insertion space, a pair of cover resist rollers 535 arranged under the paper insertion space, a forward end stopper 536 arranged above the paper insertion space along the cover feed direction, and a transverse aligning member 537 arranged in the paper insertion space above the pair of cover resist rollers 535.

The forward end of the cover C fed by the cover feeding part 52 is moved upward along the guide plate 512, to come into contact with the forward end stopper 536. Further, the cover C is so fed that its back portion is bent downward, and passed through the guide plates 531 and 532 so that its lower end is regulated by the pair of cover resist rollers 535.

The cover detection part 538 provided above the pair of cover resist rollers 535 detects passage of the cover back portion, and after a constant time (when the cover back portion is in contact with the pair of cover resist rollers 535 and the cover rear end is upstream the pair of cover feed rollers 526), at least the upper one of the pair of cover feed rollers 526 retracts from the cover feeding path.

Due to the retraction of at least one of the cover feed rollers 526, the rear end of the cover C engages with a concave portion 527a of the cover feeding guide 527 due to its toughness. Thus, the rear end position of the cover C is regulated so that its back portion is set in the paper insertion part 53 in a state placed on the pair of cover resist rollers 535 in a V-shaped manner.

After the cover C is set in the paper insertion part 53, the transverse aligning member 537 moves perpendicularly to the cover feed direction. Thus, the cover end surface is pressed against an alignment reference plate (not shown) which is opposed to the transverse aligning member 537, so that its position is regulated.

The paper feeding part 54 has the feeding path 67 which is extended to a portion above the pair of cover resist rollers 535, a pair of feed rollers 541 for feeding the paper bunch to the paper insertion part 53, and a detection part 543 for detecting the papers P in the feeding path 67. The paper bunch fed by the pair of feed rollers 541 falls by its own weight in the cover C opening upward in the paper insertion part 53. End portions of the papers P to be stuck to each other are aligned with each other by this falling.

The heating part 55 is formed by a heating plate 551 for heating the back portion of the cover C fed from the paper insertion part 53, a heater 552 arranged under the heating plate 551, a reflector 553 which is formed to enclose a lower portion of the heater 552 for concentrating the heat of the heater 552 to the heating plate 551, a heater support plate 554 integrally holding the heating plate 551, the heater 552 and the reflector 553, a shielding adiabatic member 555 which is mounted on the heater support plate 554, and a temperature detection part 556.

When the paper bunch is inserted in the cover C in the paper insertion part 53, the pair of cover feed rollers 526 press end portions of the cover C, and thereafter at least one of the pair of cover resist rollers 535 retracts from the paper insertion space. The pair of cover resist rollers 535 are normally rotated to simultaneously rotate the pair of cover feed rollers 526, for introducing the cover C and the paper bunch into the heating part 55 under the paper insertion part 53. Driving of the pair of cover feed rollers 526 and the pair of cover resist rollers 535 is stopped, and the pair of cover feed rollers 526 separate from each other while the pair of cover resist rollers 535 simultaneously press the cover C and the paper bunch. Thus, the end portions of the paper bunch in the cover C are further aligned with each other.

Thereafter the cover back portion is heated on the heating plate 551 at a proper temperature for a constant time while the pair of cover resist rollers 535 press the cover C and the paper bunch thereby melting an adhesive fixed to the cover back portion and sticking the cover C and the paper bunch to each other. Thereafter the pair of cover resist rollers 535 are normally rotated to discharge the cover C and the paper bunch after a time reliably sticking the same to each other.

The discharge part 56 is formed by a discharge guide 561, a close plate 562 and a discharge tray 563, so that the cover C fed from the heating part 55 slips down along the inclined discharge guide 561 by its own weight to be stored in the discharge tray 563.

<Operation Panel OP>

Figure 6:
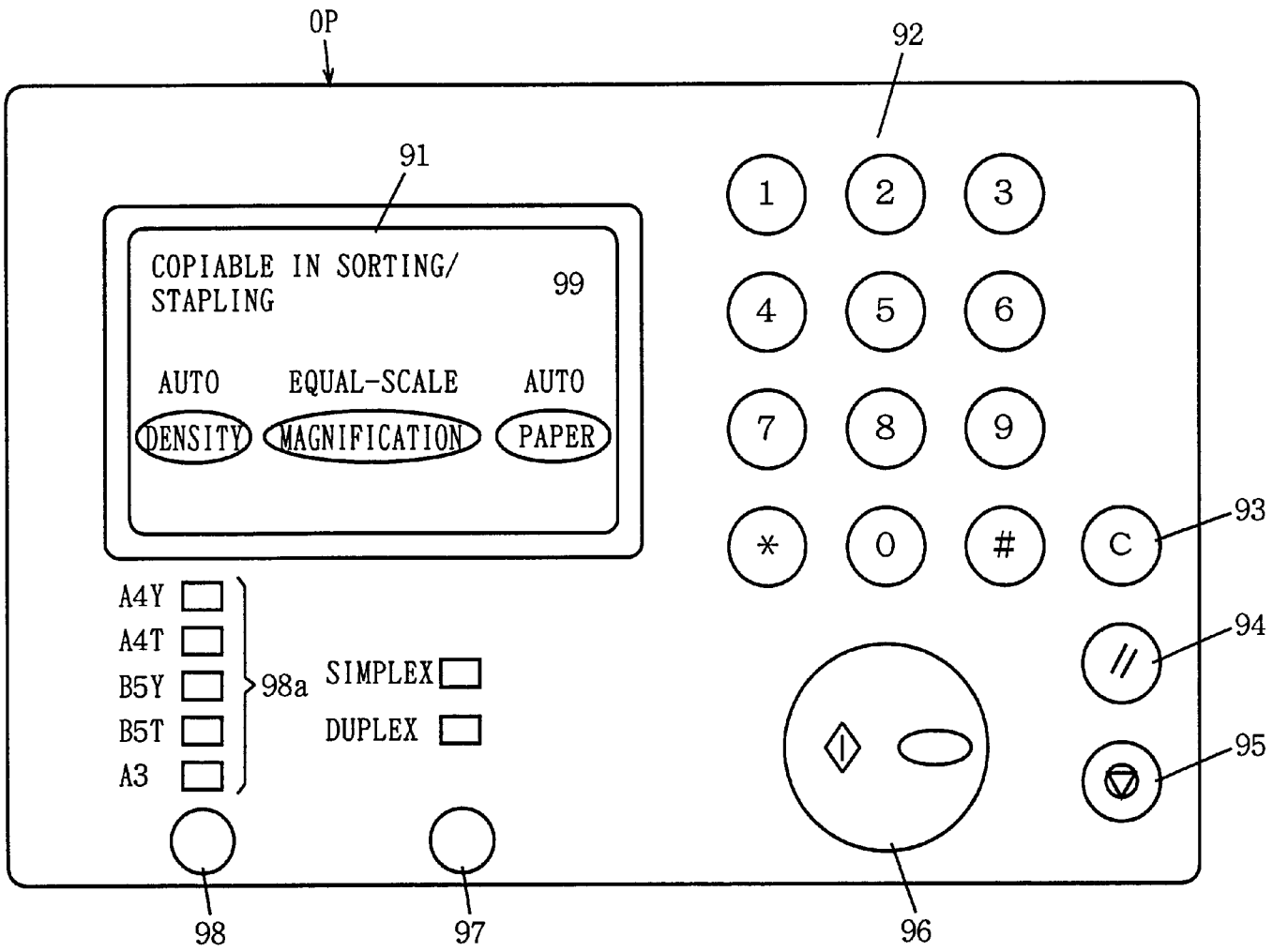
FIG. 6 is a plan view showing an operation panel.

FIG. 6 is a front elevational view of the operation panel OP. Referring to FIG. 6, the operation panel OP is provided with a liquid crystal touch panel 91, ten keys 92 for inputting a numeric value and a magnification, a clear key 93 for returning the numeric value to a standard value "1", a panel reset key 94 for returning set values etc. in the copying machine 10 to standard values, a stop key 95 for stopping the copying operation, a start key 96 for starting the copying operation, a mode set key 97 for setting a copy mode, and a paper selection key 98 for selecting the paper size. When the size of the supplied papers is selected by the paper selection key 98, a paper display part 98*a* displays the selected size. For example, "A4Y" indicates transverse setting of A4 papers, and "B5T" indicates vertical setting of B5 papers. The longitudinal direction of transversely set papers is perpendicular to the paper feed direction, and that of vertically set papers is identical to the paper feed direction. The liquid crystal touch panel 91 displays various states of the copying machine 10 such as a jamming state, a serviceman call state and a paper empty state, operation modes of the copying machine 10 such as the exposure level, the magnification and the paper size and other information, and is employed for selecting the operation modes.

<Concrete Action of Finisher 1>

The concrete action of the finisher 1 is now described.

Figure 7:
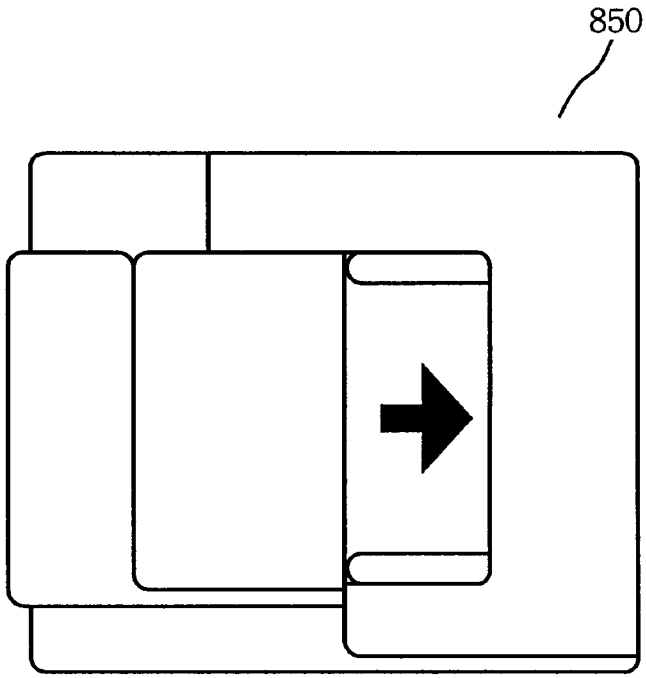
FIG. 7 is a plan view showing an ADF.

FIG. 7 is a plan view of the ADF 850. Referring to FIG. 7, the user sets an original to be copied along arrow while directing the surface to be copied upward.

Figure 8:
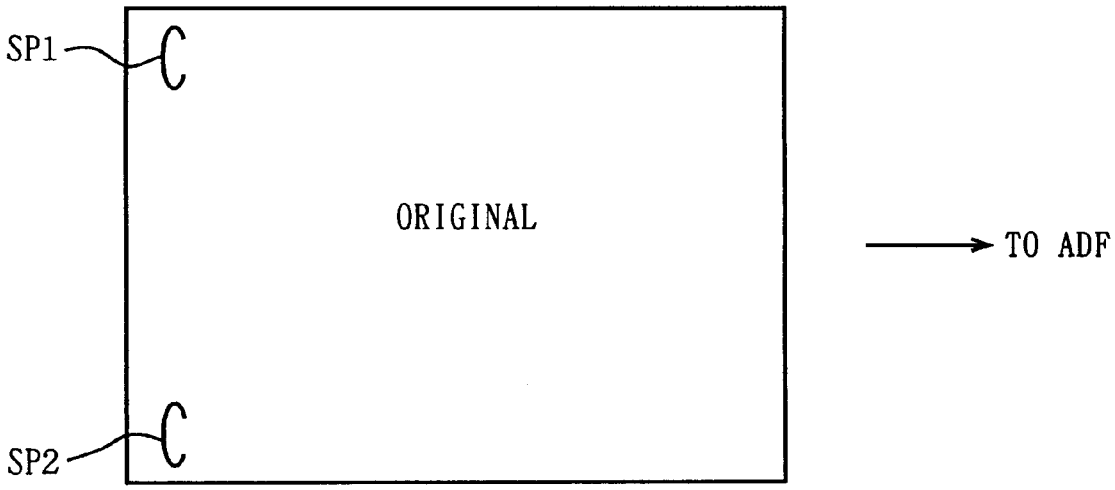
FIG. 8 is adapted to illustrate positions allowing corner stapling.

FIG. 8 is adapted to illustrate corner stapling by the stapling part 3.

This figure shows the relation between the direction of the original set on the ADF 850 and positions SP1 and SP2 for stapling copy papers for the original.

When a corner stapling function is set, corners of the papers are stapled after copying. The position SP1 or SP2 is selected as the position for stapling.

Figure 9:
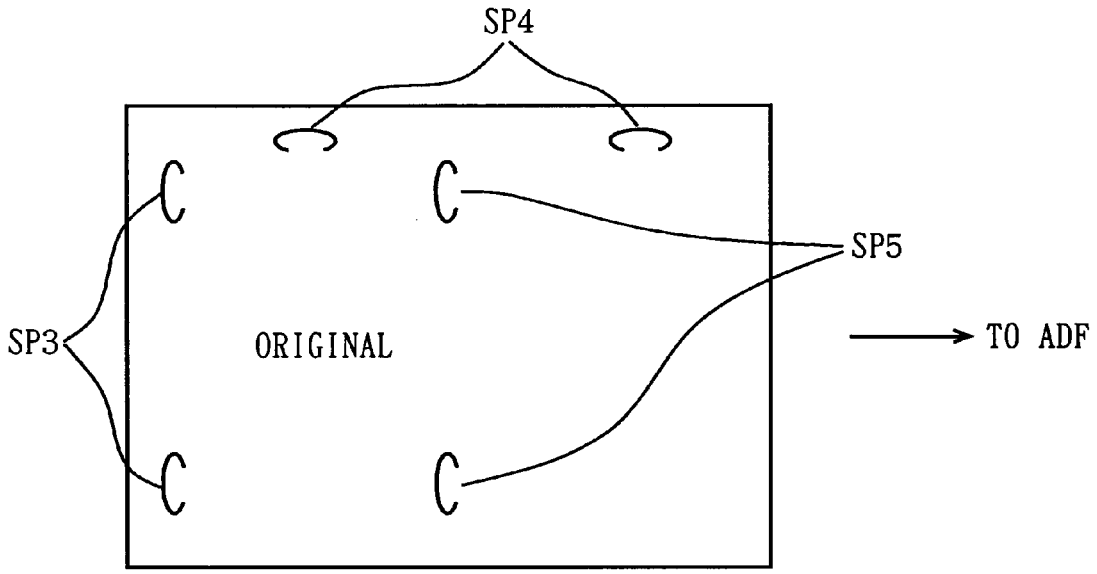
FIG. 9 is adapted to illustrate positions allowing two-point stapling.

FIG. 9 is adapted to illustrate two-point stapling. When a two-point stapling function is set, two points of each paper are stapled after copying.

Positions SP3, SP4 or SP5 are selected as the positions for stapling. Papers stitched at the positions SP5 can form a book when bent along the positions SP5.

Figure 10:
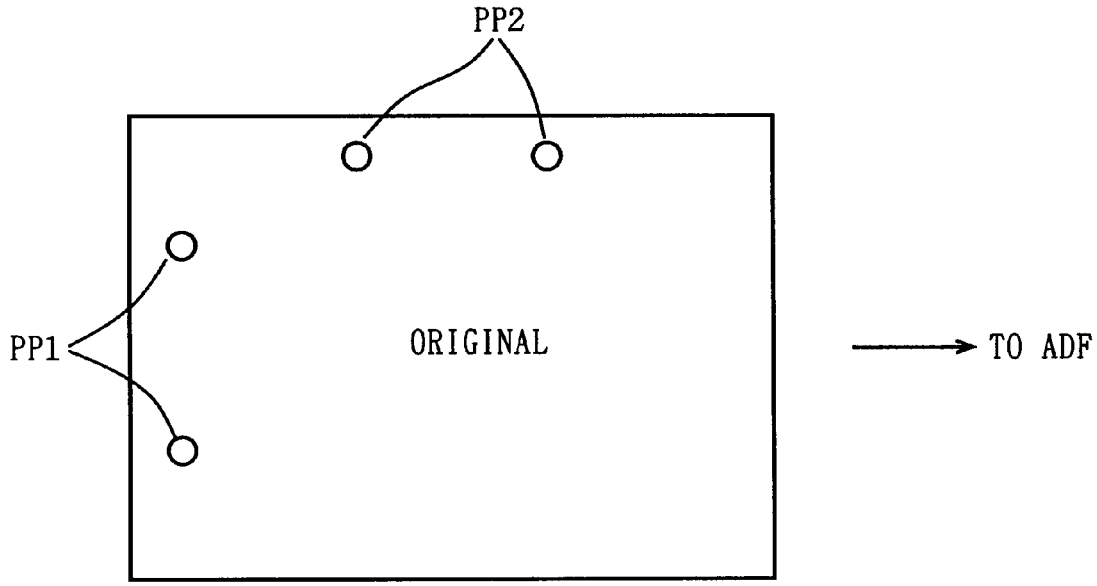
FIG. 10 is adapted to illustrate positions allowing punching.

FIG. 10 is adapted to illustrate punching.

When a punching function is set, the papers are punched after copying. Positions PP1 or PP2 are selected as the positions for punching.

<Operations of Respective Parts>

Figure 11:
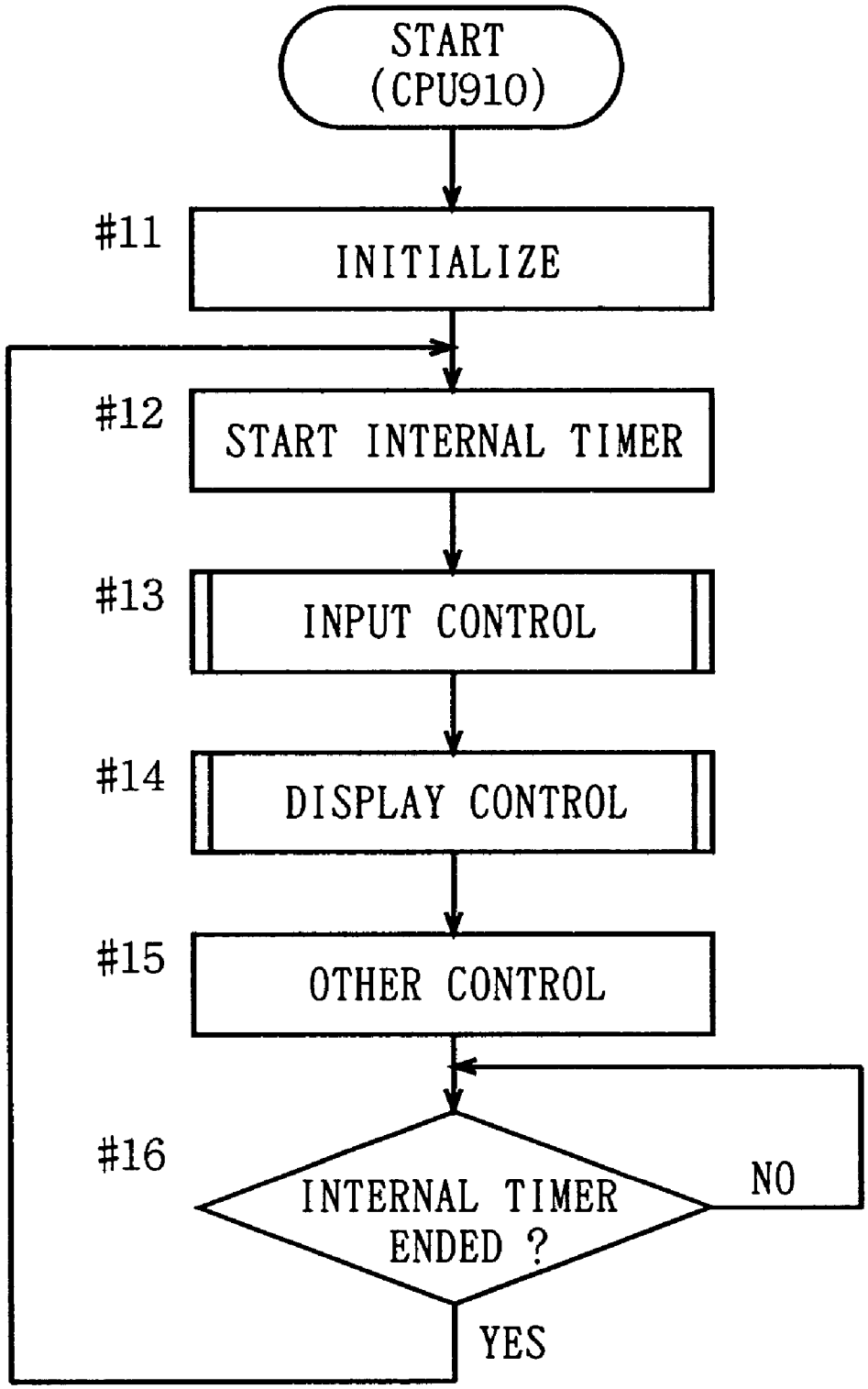
FIG. 11 is a flow chart showing the main routine of the copying machine.

FIG. 11 is a flow chart showing the main routine of the CPU 910 for the copying machine 10.

After initialization (step #11; the term "step" is hereinafter omitted), the CPU 910 starts an internal timer to monitor the copying machine 10 so that the routine time is constant (#12 and #16), performs input control processing and display control processing on the operation panel OP and the like (#13 and #14), and performs other processing (#15). The CPU 910 communicates with the remaining CPUs by interrupt processing.

Figure 14:
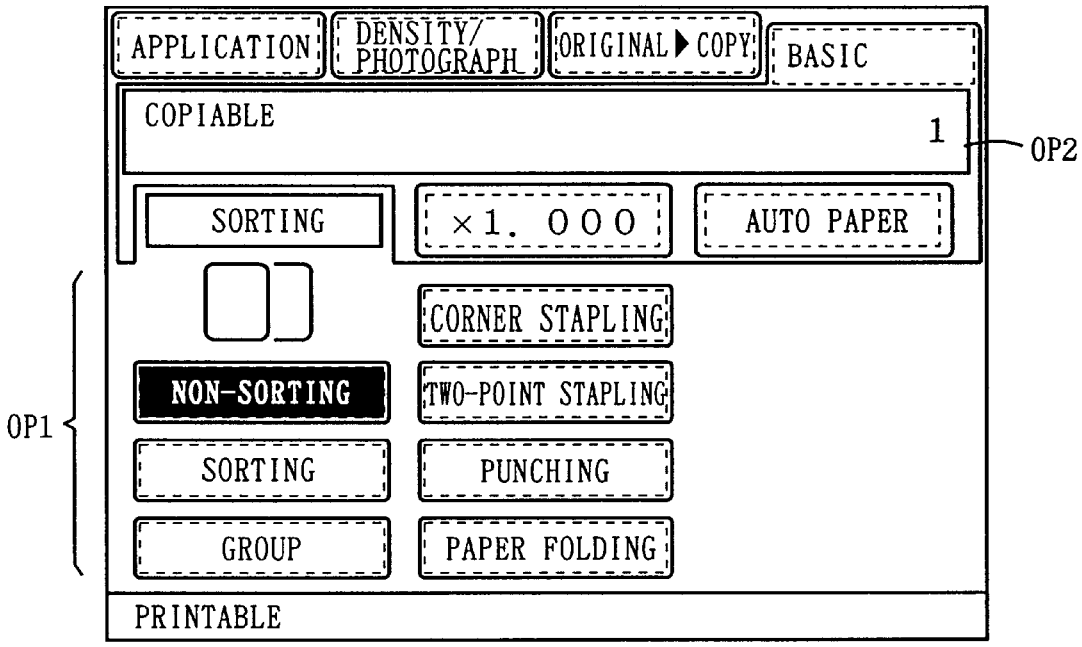
FIG. 14 illustrates a screen displayed in initialization.

In the initialization at #11, the liquid crystal touch panel 91 displays a screen shown in FIG. 14. In the screen shown in FIG. 14, the touch panel 91 displays function set keys OP1 and a copy number key OP2.

The function set keys OP1 include a non-sort key, a sort key, a group key, a corner stapling key, a two-point stapling key, a punching key and a paper folding key. The user can set each function by touching each key. The key corresponding to the set function is inversely displayed.

In the initialization, only the non-sort function is set as shown in FIG. 14.

Figure 12:
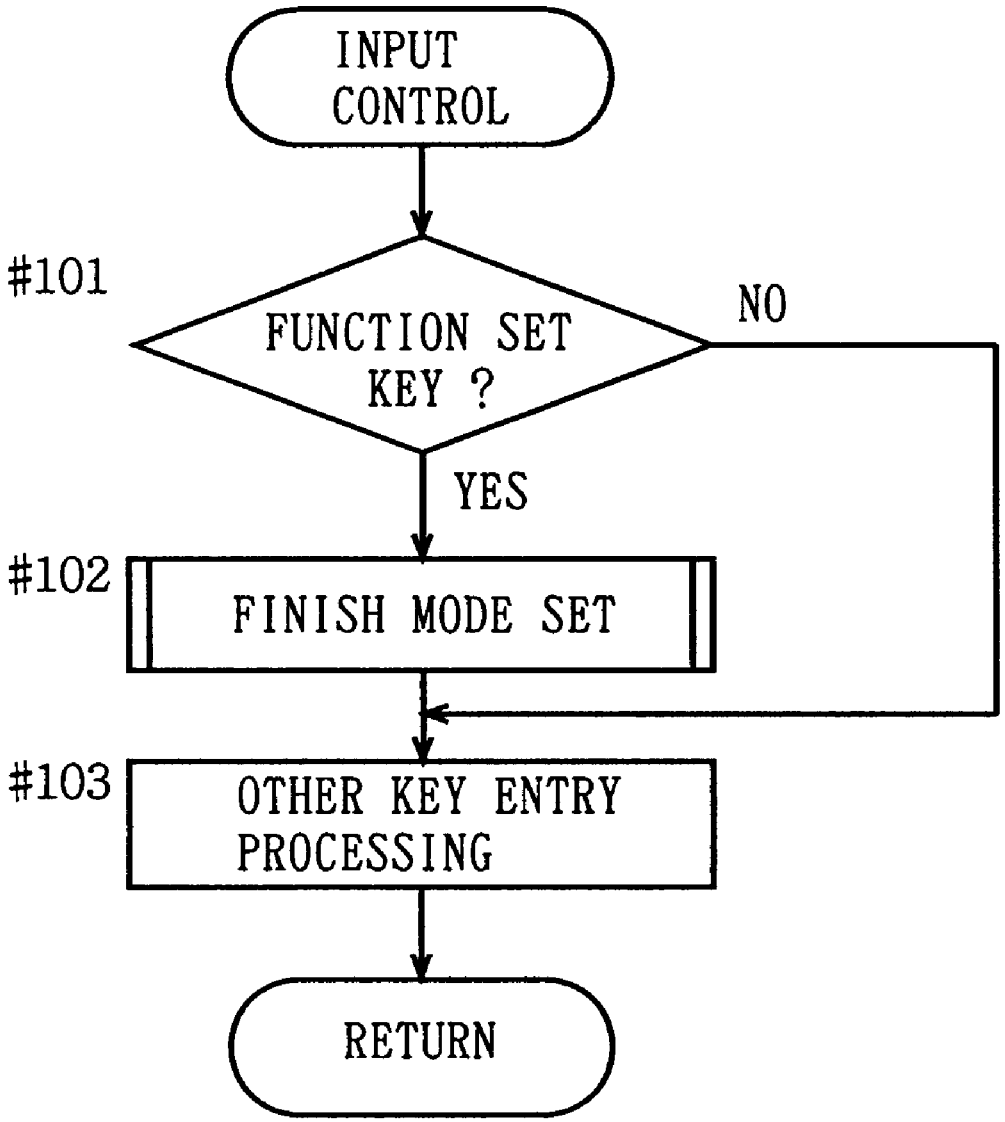
FIG. 12 is a flow chart showing an input control routine (#13) in FIG. 11.

FIG. 12 is a flow chart of the input control step (#13) shown in FIG. 11.

At #101, the CPU 910 determines whether or not any function set key OP1 is touched. If the determination is of YES, the CPU 910 sets a finish mode described later at #102. The CPU 910 performs other key entry processing at #103, and returns.

Figure 13:
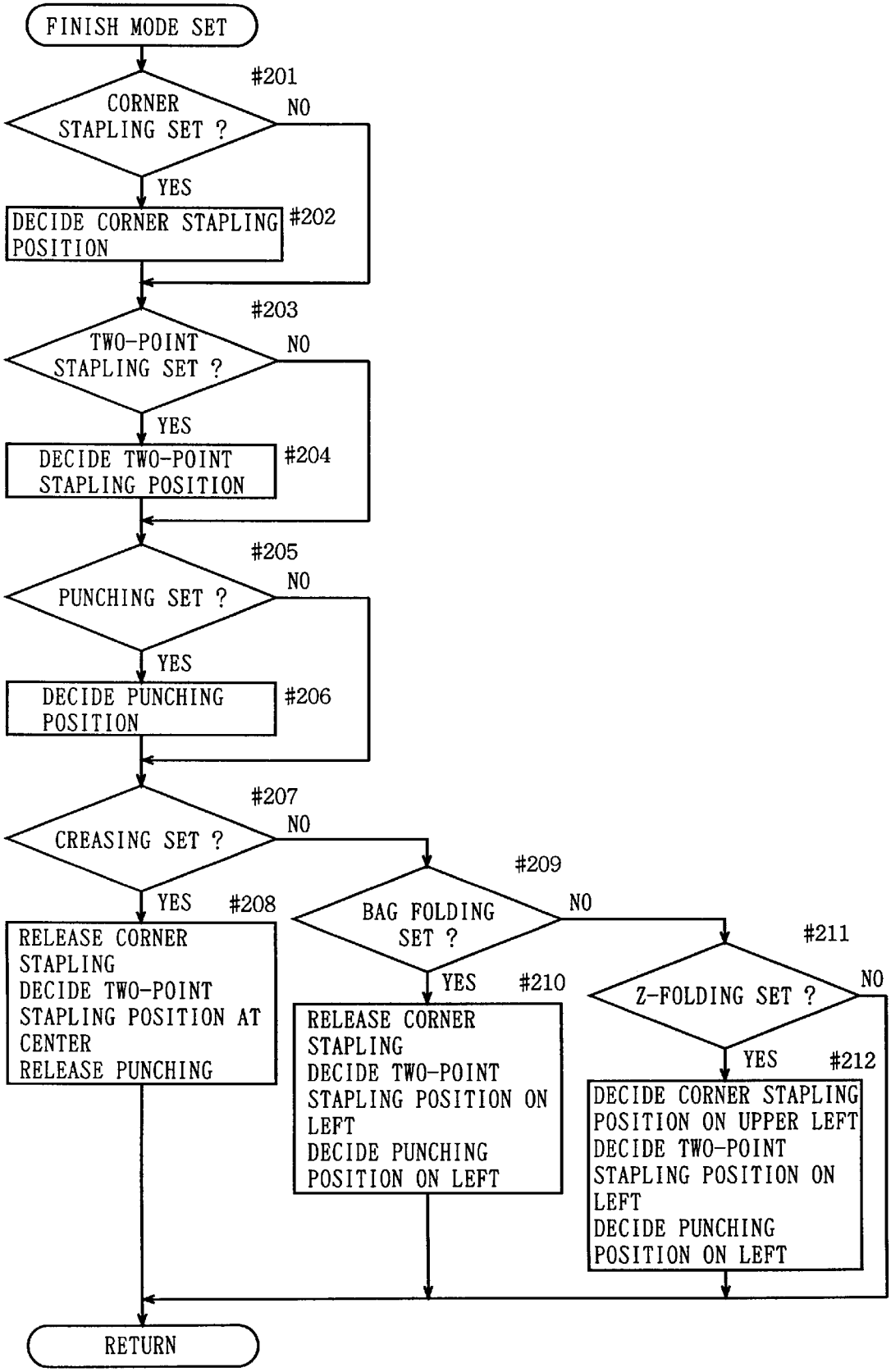
FIG. 13 is a flow chart showing the processing at a finish mode setting step (#102) in FIG. 12.

FIG. 13 is a flow chart showing the finish mode set step (#102).

Figure 15:
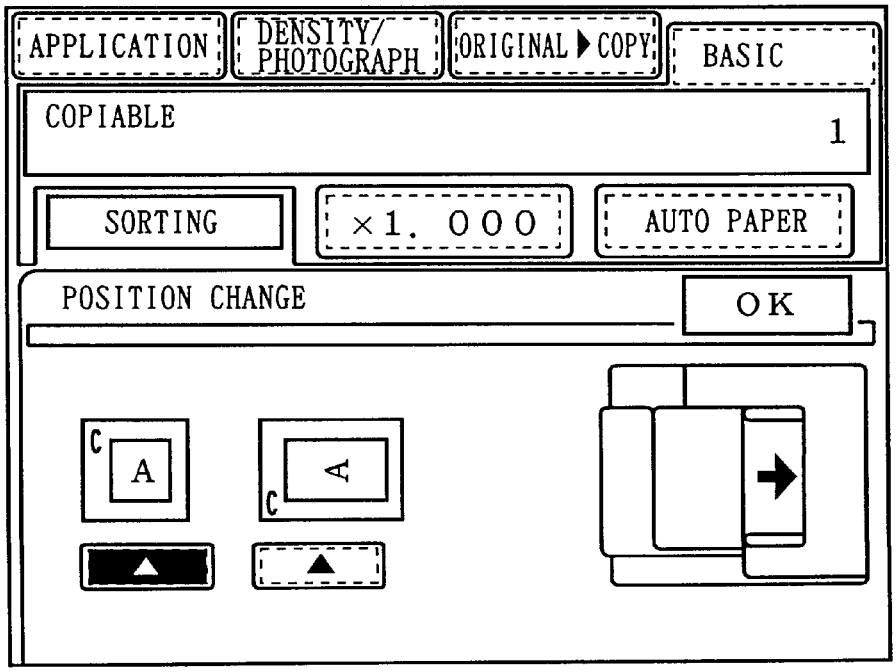
FIG. 15 illustrates a corner stapling position set screen.

The CPU 910 determines at #201 whether or not corner stapling is set through the function set key OP1, and if the determination is of YES, the touch panel 91 displays a corner stapling position set screen (FIG. 15) at #202 for setting the corner stapling position SP1 or SP2 in FIG. 8 on the basis of the input by the user.

Figure 16:
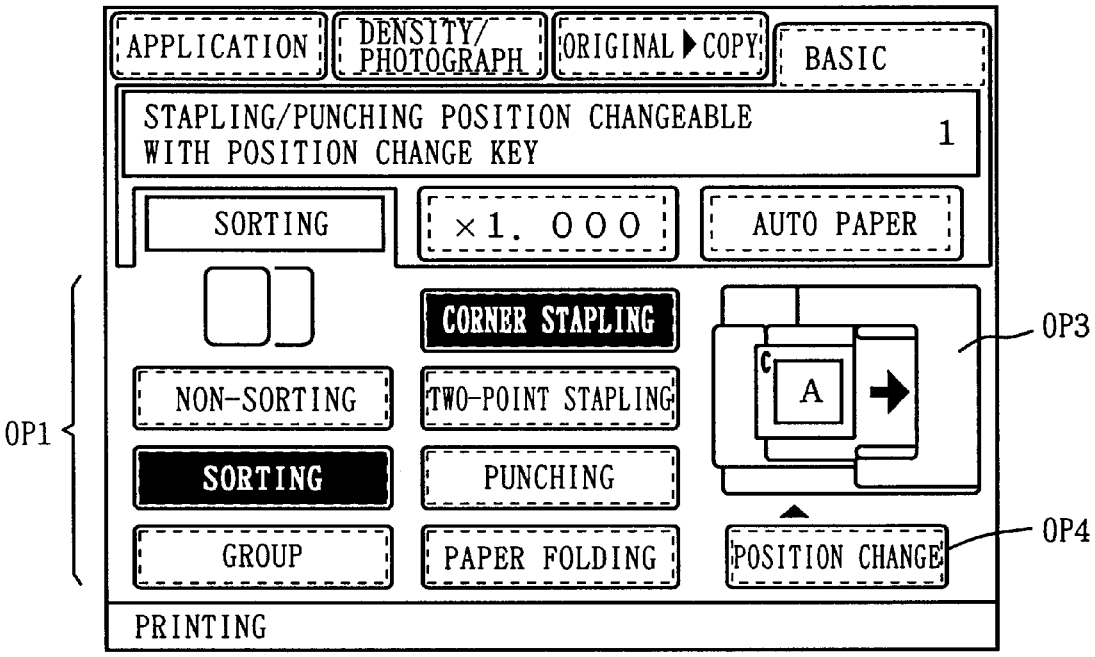
FIG. 16 illustrates a screen for selecting corner stapling.

Then, the liquid crystal touch panel 91 displays a screen shown in FIG. 16. Referring to FIG. 16, the stapling position SP1 or SP2 is displayed on a position display image OP3. Further, a position change key OP4 is displayed. In order to change the stapling position SP1 or SP2, the user touches the position change key OP4 so that the touch panel 91 displays the screen shown in FIG. 15 again.

Figure 17:
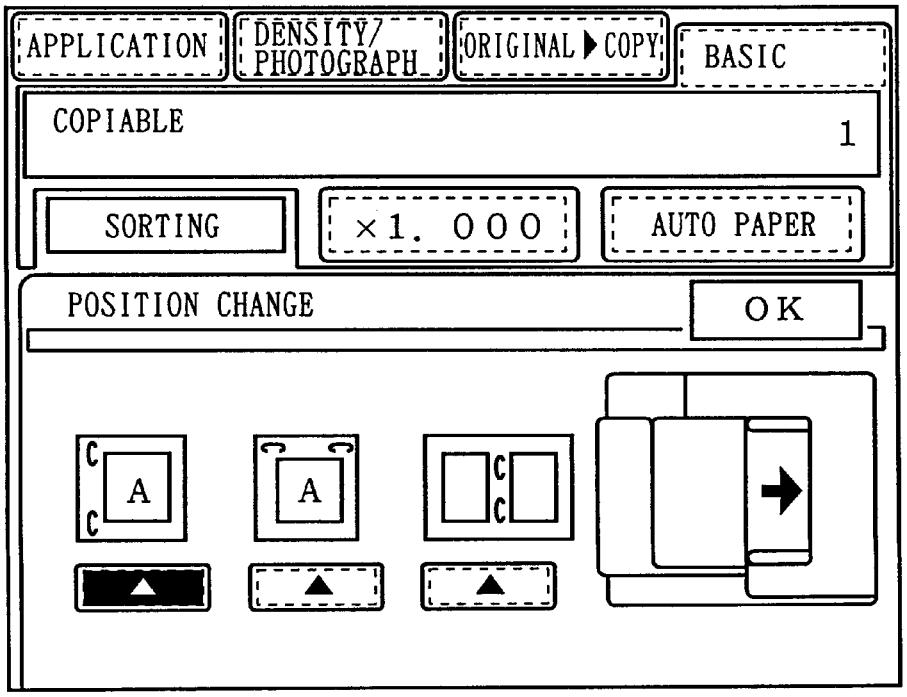
FIG. 17 illustrates a two-point stapling position set screen.

Referring again to FIG. 13, the CPU 910 determines whether or not two-point stapling is set through the function set key OP1. If the determination is of YES, the touch panel 91 displays a two-point stapling position set screen (FIG. 17) at #204 for setting the positions SP3, SP4 or SP5 shown in FIG. 9 for two-point stapling on the basis of the input by the user.

Figure 18:
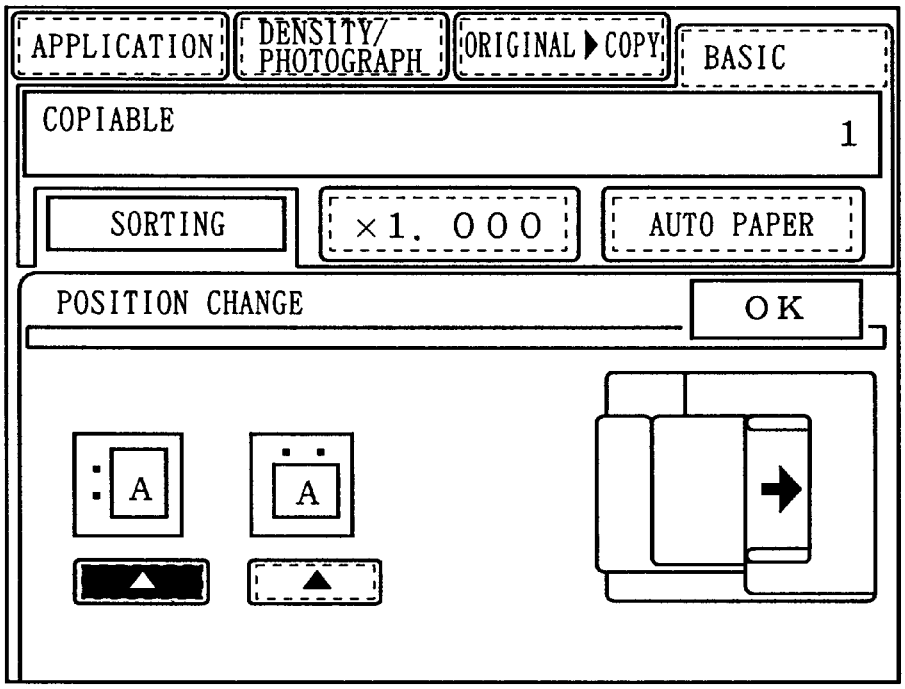
FIG. 18 illustrates a punching function position set screen.

Then, the CPU 910 determines at #205 whether or not punching is set through the function set key OP1. If the determination is of YES, the touch panel 91 displays a punching position set screen (FIG. 18) at #206 for setting the positions PP1 or PP2 in FIG. 10 for punching on the basis of the input from the user.

Then, the CPU 910 determines at #207 whether or not a creasing function is set. The user sets the creasing function or the like as follows:

First, the user touches the paper folding key included in the function set keys OP1 on the screen shown in FIG. 14 (or FIG. 16). Then, the touch panel 91 displays a paper folding set screen shown in FIG. 19. The user can select and set a desired one from creasing, bag-folding and Z-folding. The term "creasing" indicates a function of creasing the papers at the center. This function is mainly employed for stapling the creased portions of the papers thereby making a book.

The term "bag-folding" indicates a function of folding the papers at the center. The term "Z-folding" indicates a function of folding the papers in the form of Z as viewed sideways.

Figure 19:
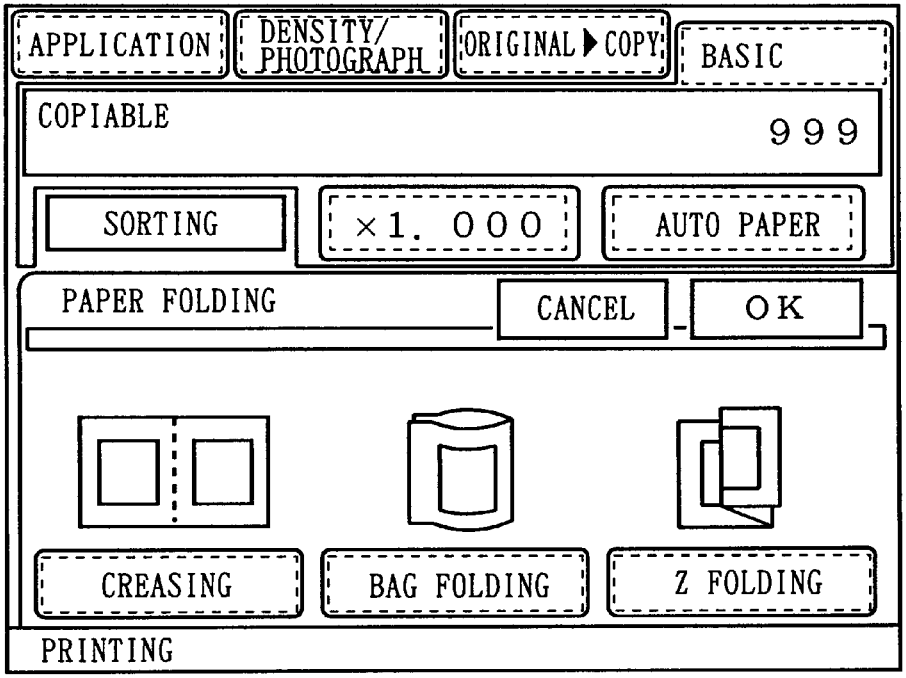
FIG. 19 illustrates a paper folding set screen.
Figure 20:
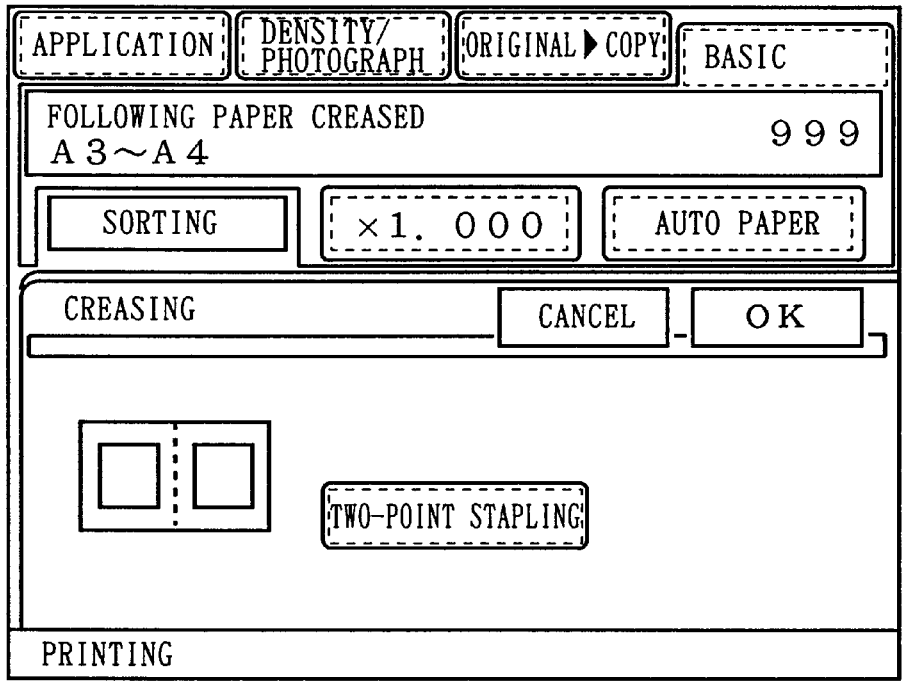
FIG. 20 illustrates a creasing set screen.

When the user touches a creasing key in the state shown in FIG. 19, the touch panel 91 displays a creasing set screen shown in FIG. 20. When the user touches an OK key on the right central portion of the screen, the CPU 910 sets the creasing function. When the user touches a cancel key, on the other hand, the CPU 910 sets no creasing function. On the screen shown in FIG. 20, the user can set/release only the two-point stapling function.

Figure 21:
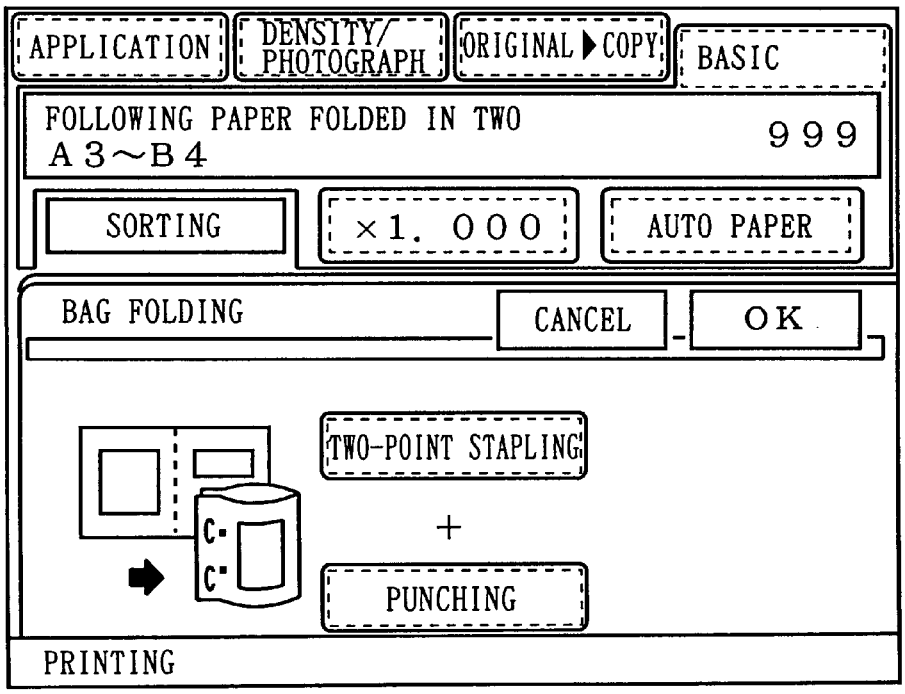
FIG. 21 illustrates a bag-folding set screen.

If the user touches a bag-folding key in the state shown in FIG. 19, the touch panel 91 displays a bag-folding set screen shown in FIG. 21. When the user touches the OK key, the CPU 910 sets the bag-folding function.

On the screen shown in FIG. 21, the user can set/release the two-point stapling function and/or the punching function.

Figure 22:
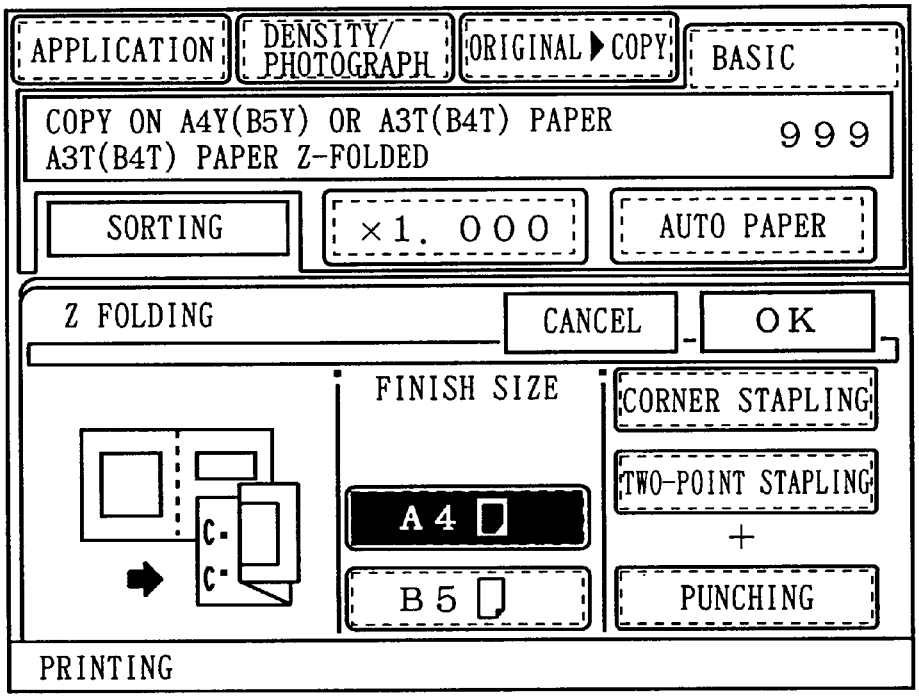
FIG. 22 illustrates a Z-folding set screen.

When the user touches a Z-folding key in the state shown in FIG. 19, the touch panel 91 displays a Z-folding set screen shown in FIG. 22. When the user touches the OK key, the CPU 910 sets the Z-folding function.

On the screen shown in FIG. 22, the user can set/release the corner stapling function, the two-point stapling function, the corner stapling function and the punching function, or the two-point stapling function and the punching function.

On the screen shown in FIG. 22, further, the user can select the A4 or B5 size as the finished size of the Z-folded papers.

If the determination at #207 in FIG. 13 is of YES, the CPU 910 releases the corner stapling function at #208 if this function is set. If the two-point stapling function is set, on the other hand, the CPU 910 sets the stapling positions at the center (SP5 in FIG. 9). If the punching function is set, the CPU 910 releases this function.

When the paper folding function and a function of processing prescribed positions of the papers are set together, the CPU 910 sets the copying machine 10 to process positions suitable for processing the folded papers.

Referring to FIG. 20, the papers are creased at the center after copying when the creasing function is executed, and hence execution of the corner stapling or punching function is meaningless. Therefore, the CPU 910 releases this function at #208.

When the creasing function is set, execution of two-point stapling on the positions SP3 or SP4 in FIG. 9 is meaningless. When the creasing and two-point stapling functions are set together, therefore, the CPU 910 forcibly sets the stapling positions at the center (SP5 in FIG. 9).

Figure 23:
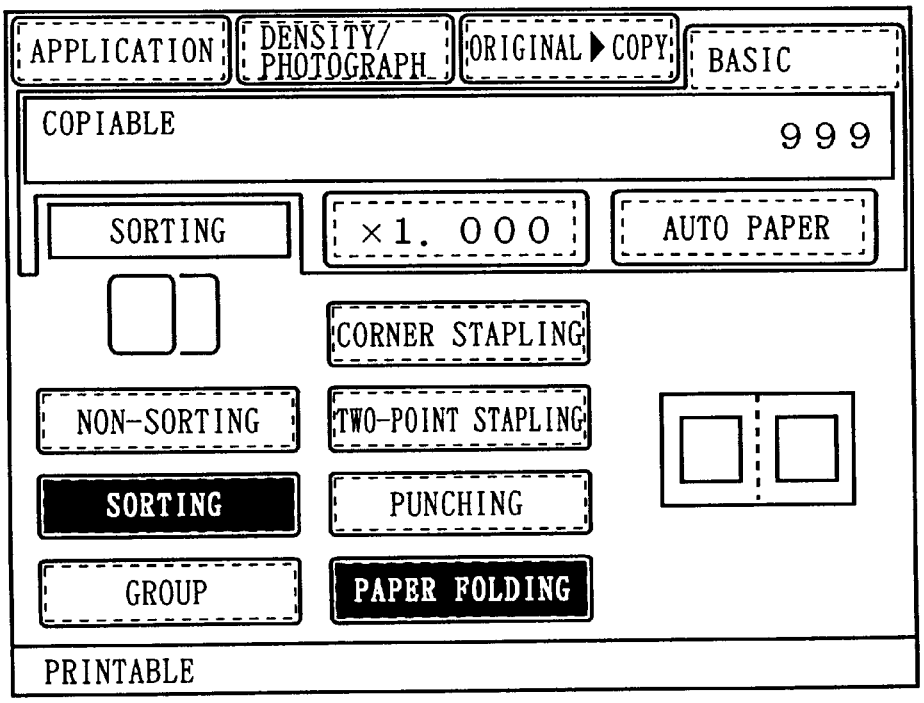
FIG. 23 illustrates a state for setting a paper folding function.

For example, the corner stapling function set in the state shown in FIG. 16 is released (#208) if the user sets the creasing function through the process shown in FIG. 20 (YES at #207 in FIG. 13), and the touch panel 91 displays a screen shown in FIG. 23. Referring to FIG. 23, the inverse display of the corner stapling key is erased and the creasing function key is displayed in place.

If the determination at #207 is of NO, the CPU 910 determines at #209 whether or not the bag-folding function is set. If the determination is of YES, the CPU 910 releases the corner stapling function at #210, and if the two-stapling function is set, the CPU 910 sets the two-point stapling positions on the left (SP3 in FIG. 9). When the punching function is set, the CPU 910 also sets the punching positions at the left (PP1 in FIG. 10).

When the bag-folding function is set as shown in FIG. 21, only the left positions are meaningful for the two-point stapling or punching, and hence the CPU 910 sets such meaningful positions. When the bag-folding function is set, further, corner stapling is unsuitable and hence the CPU 910 releases this function.

If the determination at #209 is of NO, the CPU 910 determines at #211 whether or not the Z-folding function is set. If the determination is of YES, the CPU 910 sets the upper left corner stapling position (SP1 in FIG. 8). Or, the CPU 910 sets the left two-stapling positions (SP3 in FIG. 9). Or, the CPU 910 sets the left punching positions (PP1 in FIG. 10).

When the Z-folding function is set as shown in FIG. 22, the left positions are suitable for the two-point stapling or punching, while the left upper position is suitable for the corner stapling. Therefore, the CPU 910 sets the suitable position(s).

According to this embodiment, as hereinabove described, the copying machine 10 can automatically set preferable positions for processing the papers when the function of processing prescribed positions of the papers and the paper folding function are set together. Thus, the user can readily and unerringly set the copying machine 10.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus comprising:

a finisher for executing automatic sheet folding for folding a sheet, automatic stapling for stapling a sheet, and automatic punching for punching a sheet; and a controller for setting said automatic sheet folding, and for setting positions to be stapled and punched by said automatic stapling and said automatic punching on the sheet to be subjected to said automatic sheet folding in accordance with the setting of said automatic folding, wherein said controller sets the positions on said sheet to be stapled and punched by said automatic stapling and said automatic punching in response to an instruction from a user, and, when the automatic sheet folding is set, changes the set positions on said sheet to be stapled and punched by said automatic stapling and said automatic punching.

2. An image forming apparatus comprising:

an image forming means for forming an image on a sheet;

an automatic sheet folding means for folding a sheet on which the image has been formed by said image forming means in a plurality of different folding modes;

an automatic stapling means for stapling the sheet on which the image has been formed by said image forming means;

a first setting means for selectively setting one of the plurality of folding modes;

a second setting means for setting a position on the sheet to be stapled by said automatic stapling means in accordance with the folding mode set by said first setting means; and a third setting means for setting the position on the sheet to be stapled by said automatic stapling means in response to an instruction from a user, wherein, when the folding mode is set by said first setting means, said second setting means changes the position set by said third setting means in accordance with the folding mode set by said first setting means.

3. An image forming apparatus comprising:

an image forming means for forming an image on a sheet;

an automatic sheet folding means for folding a sheet on which the image has been formed by said image forming means in a plurality of different folding modes;

an automatic punching means for punching the sheet on which the image has been formed by said image forming means;

a first setting means for selectively setting one of the plurality of folding modes;

a second setting means for setting a position on the sheet to be punched by said automatic punching means in accordance with the folding mode set by said first setting means; and a third setting means for setting the position on the sheet to be punched by said automatic punching means in response to an instruction from a user, wherein, when the folding mode is set by said first setting means, said second setting means changes the position set by said third setting means in accordance with the folding mode set by said first setting means.

4. An image forming apparatus comprising:

an image forming unit which forms an image on a sheet;

an automatic sheet folder which folds a sheet on which the image has been formed by said image forming unit in a plurality of different folding modes;

an automatic stapler which staples the sheet on which the image has been formed by said image forming unit;

a controller which selectively sets one of the plurality of folding modes and sets a position on the sheet to be stapled by said automatic stapler in accordance with the set folding mode, wherein said controller sets the position on the sheet to be stapled by said automatic stapler in response to an instruction from a user, and when the folding mode is set, changes the set position in accordance with the set folding mode.

5. An image forming apparatus comprising:

an image forming unit which forms an image on a sheet;

an automatic sheet folder which folds a sheet on which the image has been formed by said image forming unit in a plurality of different folding modes;

an automatic puncher which punches the sheet on which the image has been formed by said image forming unit;

a controller which selectively sets one of the plurality of folding modes and sets a position on the sheet to be punched by said automatic puncher in accordance with the set folding mode, wherein said controller sets the position on the sheet to be punched by said automatic puncher in response to an instruction from a user, and when the folding mode is set, changes the set position in accordance with the set folding mode.

6. An image forming apparatus comprising:

an image forming unit which forms an image on a sheet;

an automatic sheet folder which folds the sheet, said automatic sheet folder operating in a first folding mode or a second folding mode different from the first folding mode;

an automatic stapler which staples the sheet; and a controller which sets the first folding mode or the second folding mode and sets a position on the sheet to be stapled by said automatic stapler in accordance with the set folding mode, wherein the relative position of the set position to the fold is different between the first folding mode and the second folding mode.

7. The image forming apparatus in accordance with claim 6, further comprising an automatic puncher which punches the sheet, and wherein said controller determines whether or not the sheet is punched by said automatic puncher in accordance with the set folding mode.

8. An image forming apparatus comprising;

an image forming unit which forms an image on a sheet;

an automatic sheet folder which folds the sheet, said automatic sheet folder operating in a first folding mode or a second folding mode different from the first folding mode;

an automatic puncher which punches the sheet; and a controller which determines whether or not the sheet is punched by said automatic puncher in accordance with the set folding mode.

9. The image forming apparatus in accordance with claim 8, further comprising an automatic stapler which staples the sheet, and wherein said controller sets a position on the sheet to be stapled by said automatic stapler in accordance with the set folding mode.

10. An image forming apparatus comprising:

an image forming unit which forms an image on a sheet;

an automatic sheet folder which folds the sheet, said automatic sheet folder operating in a first folding mode or a second folding mode different from the first folding mode;

an automatic stapler which staples the sheet; and a controller which performs the following process;

1) setting a position on the sheet to be stapled by said automatic stapler in accordance with an instruction from a user;

2) selecting the first folding mode or the second folding mode in accordance with an instruction from the user; and 3) changing the set position to be stapled into an appropriate position when the set position is inappropriate to the selected folding mode.

11. An image forming apparatus comprising:

an image forming unit which forms an image on a sheet;

an automatic sheet folder which folds the sheet, said automatic sheet folder operating in a first folding mode or a second folding mode different from the first folding mode;

an automatic puncher which punches the sheet; and a controller which performs the following process;

1) setting an automatic punching by said automatic puncher in accordance with an instruction from a user;

2) selecting the first folding mode or the second folding mode in accordance with an instruction from the user; and 3) releasing the set automatic punching when executing of the automatic punching is inappropriate to the selected folding mode.

* * * * *